United States Patent [19]

Santi

[11] 4,011,533

[45] Mar. 8, 1977

[54] MAGNETICALLY ACTUATED SWITCH FOR PRECISE RAPID CYCLE OPERATION

[75] Inventor: John Dominic Santi, West Allis, Wis.

[73] Assignee: Briggs & Stratton Corporation, Wauwatosa, Wis.

[22] Filed: Jan. 14, 1976

[21] Appl. No.: 648,892

[52] U.S. Cl. ..... 335/154; 200/288; 335/151; 335/193

[51] Int. Cl.[2] ..... H01H 51/28; H01H 3/60

[58] Field of Search ..... 335/154, 151, 193, 104, 335/105, 90, 192, 194; 200/288

[56] References Cited

UNITED STATES PATENTS

| | | | |
|---|---|---|---|
| 2,421,267 | 5/1947 | Huber | 200/288 |
| 3,586,809 | 6/1971 | Santi | 335/154 |

*Primary Examiner*—Harold Broome
*Attorney, Agent, or Firm*—Ira Milton Jones & Associates

[57] ABSTRACT

In a magnetically actuated switch such as is disclosed in U.S. Pat. No. 3,586,809, the armature stop against which the armature engages in its switch-open position has a pair of vibratile members attached to its tip, in vibration transmitting relation to it and extending lengthwise from it. The two vibratile members are tuned to different frequencies, both lower than that of the armature stop. They so control vibration of the armature stop as to quickly stop the armature at its switch open position. Similar vibratile members on a relatively stationary contact member eliminate contact rebound upon switch closure.

13 Claims, 6 Drawing Figures

Fig. 1
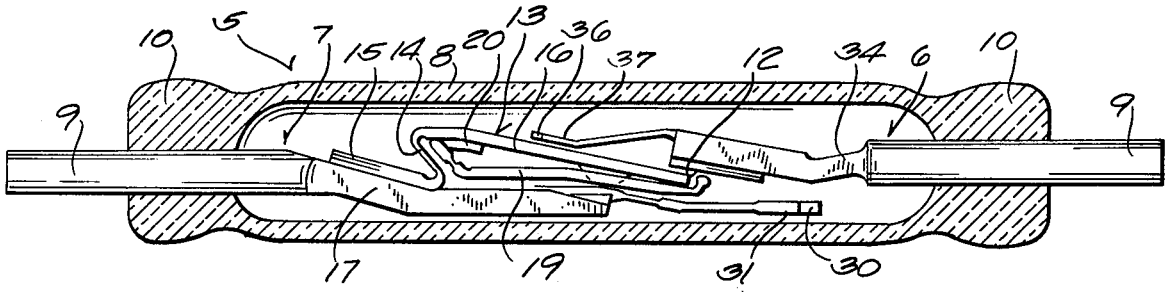
Fig. 2
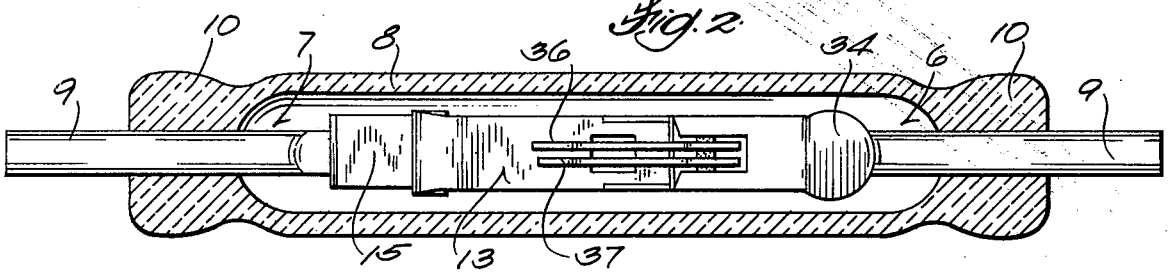
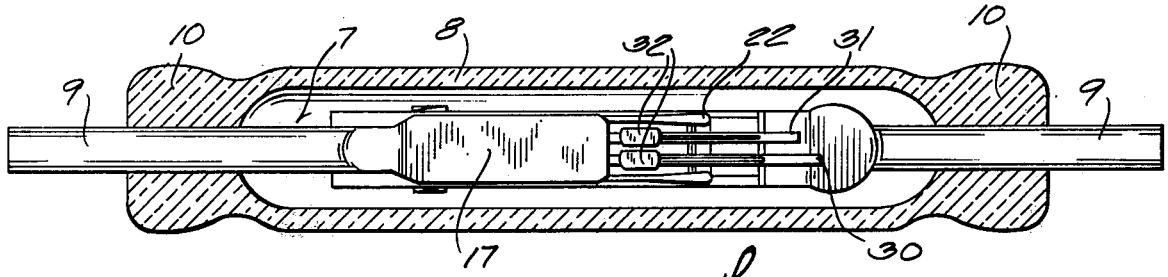
Fig. 3
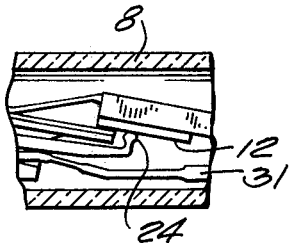
Fig. 4

6
34
36
37
12
26
27
33
28
13
16
15
14
19
24
20
22
31
30
32
18
7
17

MAGNETICALLY ACTUATED SWITCH FOR PRECISE RAPID CYCLE OPERATION

This invention relates to electrical switching devices that have armatures which move rapidly between switch-open and switch-closed positions; and the invention is more particularly concerned with magnetically actuated switches that are intended to be closed at recurrent intervals of very short but variable duration.

A switch of the general type to which the present invention relates is disclosed in U.S. Pat. No. 3,586,809, to J. D. Santi. The switching device of that patent represented a very marked advance over the prior art, in that it was capable of handling substantially higher power than comparable prior switches, had a useful life (in terms of operation cycles) that was on the order of thousands of times the useful life of the best prior magnetically actuated switch, and was capable of consistently accurate timing of make and break at frequencies of more than 200 operations per second, as well as at all lower cycle speeds.

Although the superlative performance of the switching device of U.S. Pat. No. 3,586,809 seemed to leave little room for improvement — and, indeed, seemed to need no improvement as compared to its prior art predecessors — intensive and very meticulous testing and observation nevertheless revealed that there was some very slight rebound of its cooperating contacts upon closure, and that it was still very slightly erratic in the timing of its closure in response to a very rapidly changing magnetic field, especially at cycling rates much above 200 operations per second.

For many applications these minor deficiencies were of no moment. But magnetically actuated switches are so efficient and versatile as to be useful in an almost endless variety of applications involving frequencies of up to a few hundred cycles per second, in many of which they can more advantageously fulfill roles otherwise assigned to solid state devices. Among other things, a magnetically actuated switch like that of the aforesaid patent has a very much higher breakdown voltage than a solid state device; has a resistance when closed which is so much lower than that of a conducting solid state device as to be practically negligible; and, because of the high power that it can handle, has a gain factor substantially in excess of that of solid state devices. Accordingly, in order for the full potential utility of such switches to be realized, it is desirable that a magnetically actuated switch should have a clean "make" performance comparable to the switch-on characteristics of an SCR or the like, and that its response to the biasing force of a rapidly changing magnetic field should be as consistent as the responses of a solid state device to changes in its electrical bias.

Of course these are very severe demands to impose upon a mechanical structure having moving parts that necessarily possess mass, resilience, inertia and the like.

Nevertheless, it is the general object of the present invention to provide a mechanical, magnetically actuated electrical switching device that substantially meets these straight requirements and is thus highly suited for applications that require recurrent completion and interruption of an electrical circuit at intervals of very short but variable duration.

More specifically, it is an object of this invention to provide a magnetically actuated electric switch device having the remarkably long operational life and the high power handling capability of the switch of U.S. Pat. No. 3,586,809, and which, in addition, closes without any contact rebound that can be detected by the most exacting tests, and responds with the utmost consistency to an actuating magnetic field that changes cyclically at any frequency up to about 400 cycles per second.

Another object of the invention is to provide a magnetically actuated switch structure that effectively utilizes the mass, inertia and resilience of moving parts to achieve a consistency and precision of response that were heretofore regarded as unattainable because of those very attributes of such parts.

The invention is herein described with particular reference to magnetically actuated switches, inasmuch as such devices can operate at much faster cycling rates than other types of switches and therefore present the most difficult problems and impose the most stringent requirements. However, it will be apparent that the principles of the invention are applicable generally to any type of switch that has an armature which is moved rapidly into abrupt engagement with a cooperating member and wherein rebounding disengagement of the armature from that member is undesirable.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 1 is a view in side elevation of a switching device embodying the principles of this invention, the envelope, however, being shown in longitudinal section;

FIG. 2 is a view looking down on the switch shown in FIG. 1, the envelope again being shown in section;

FIG. 3 is a view looking up at the switch shown in FIG. 1, the envelope again being shown in section;

FIG. 4 is a detail side view of the contact portion of the switch mechanism in its switch closed condition;

Figure 5:
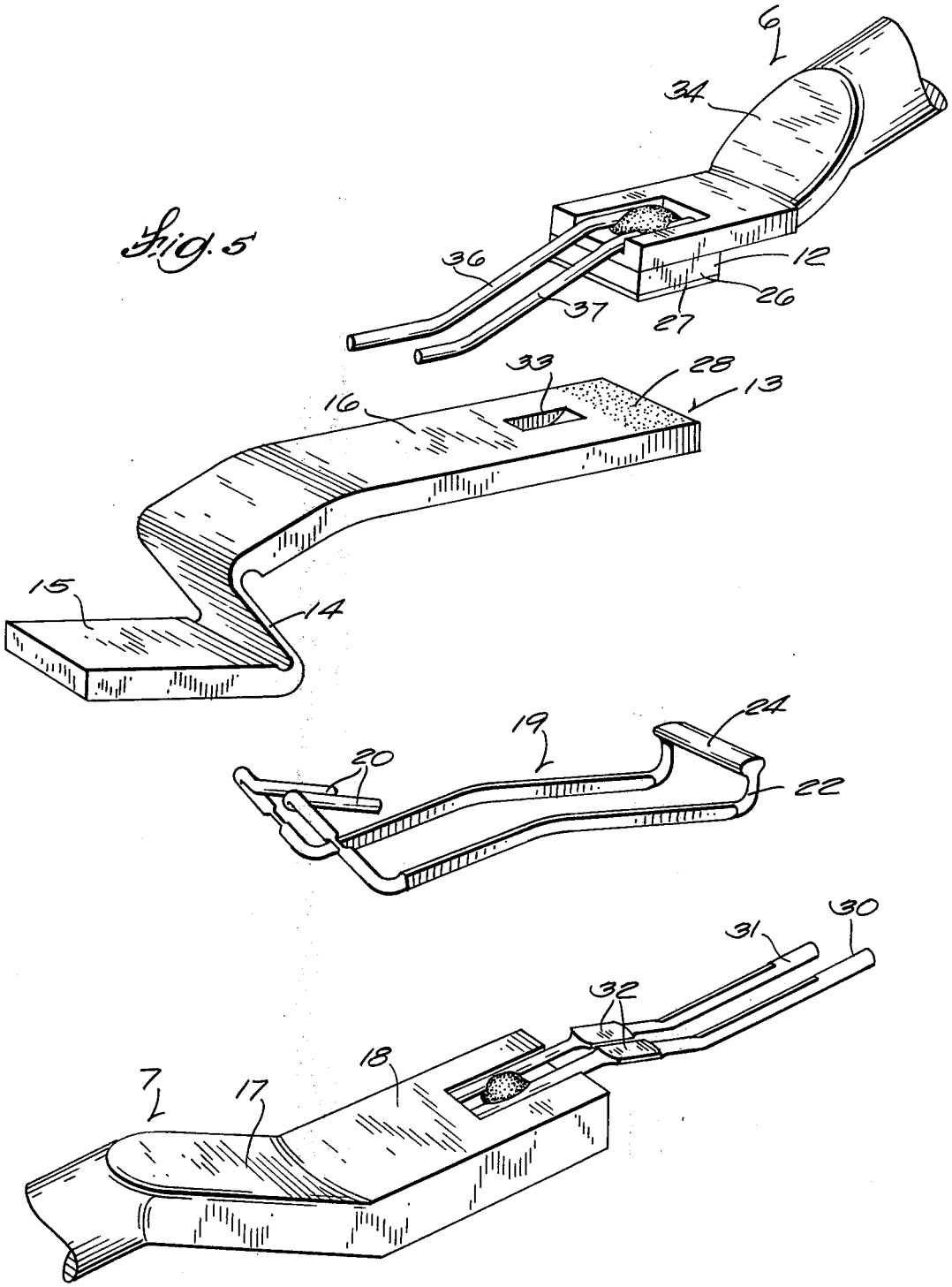
FIG. 5 is a perspective view of portions of the switch mechanism shown in disassembled relation to one another.

Referring now to the accompanying drawings, the numeral 5 designates generally an electrical switching device embodying the principles of this invention, illustrated as a normally open switch that is magnetically actuated to its closed condition. It will be understood that the switch 5 is intended for cooperation with any suitable device (not shown) for producing a varying magnetic field, and that it is intended to be connected in an electrical circuit (not shown) to open and close the same in accordance with the condition of the magnetic field that actuates it.

In general, the switch 5 comprises a pair of elongated rod-like elements 6 and 7 which extend through the end walls of an elongated, more or less cylindrical glass envelope 8 and which support the moving parts of the switch in the interior of the envelope. The exterior portions 9 of the rod-like elements, which project lengthwise in opposite directions from the envelope and are substantially coaxial to it, serve as terminals for the switch by which it can be connected in a circuit that it controls. Directly inwardly of their terminal portions the rod-like elements extend through the end walls 10 of the envelope in hermetically sealed relation thereto, to maintain a deep vacuum in the interior of the envelope in accordance with the teachings of U.S. Pat. No. 3,586,809.

The switch mechanism inside the envelope differs in specific details from the particular illustrative embodiment disclosed in U.S. Pat. No. 3,586,809, but in most respects it follows the principles explained in that patent.

In this case, both rod-like elements 6 and 7 extend a substantial distance lengthwise into the interior of the envelope, and the enclosed portion of the element 7 carries a movable armature piece that cooperates with a relatively stationary contact member 12 which comprises the inner portion of the other rod-like element 6. It should be pointed out immediately that the contact member 12 is by no means stationary in an absolute sense, inasmuch as its capability for certain movement is of the essence, as explained hereinafter; but it can be regarded as relatively stationary in the sense that it moves substantially less than the armature piece 13 with which it cooperates. The particular illustrative switch disclosed in U.S. Pat. No. 3,586,809 had two armature pieces, one of which corresponded generally to the armature piece 13 of the present switch device and the other of which provided a cooperating movable contactor. The contact member 12 moves much less than the second armature piece in that prior device, although performing essentially the same contact function, and in that respect, too, the contact member 12 can be regarded as relatively stationary.

It will be understood that both the armature piece 13 and the contact member 12 are magnetically permeable so that the armature piece will be attracted to the contact member under the influence of an actuating magnetic field.

The armature piece 13 corresponds in a general way to a reed in a prior reed switch, and on that analogy its counterpart in U.S. Pat. No. 3,586,809 was referred to therein as a reed. As the description proceeds, it will be seen that it is not a reed in the conventional sense; hence it is herein designated an armature piece. It is preferably formed as an elongated bimetal strip that has a slender neck 14 which defines an anchor or attachment portion 15 adjacent one end of the strip and a longer armature portion 16 adjacent its other end, the armature portion 16 comprising the movable armature proper of the switch device. In general, the anchor portion 15 provides for connection of the armature piece to the rod-like element 7, and the neck 14 provides for swinging of the armature portion 16 toward and from engagement with the contact member 12.

A little distance inwardly of its adjacent envelope end wall 10, the rod-like element 7 has an oblique medial portion 17 which extends inwardly at an obtuse angle to its terminal portion 9 and is thus inclined rearwardly and axially inwardly. This inclined medial portion serves as an armature piece support. The axially innermost portion 18 of the rod-like element 7 extends substantially parallel to the envelope axis and serves as an armature stop, as explained below.

The front side of the rod-like element 7 is flat along the lengths of its armature piece support portion 17 and its armature stop portion 18. The anchor portion 15 of the armature piece is flatwise affixed to the flat front surface of the armature piece support portion 17, as by spot welding; and the armature portion 16 of the armature piece extends lengthwise along the armature stop 18, in flatwise opposing relation to its front side.

The armature piece is more or less Z-shaped as viewed edgewise, having its neck portion 14 inclined at an acute angle to each of its anchor and armature portions. The neck portion has a substantially smaller cross-section area than the anchor and armature portions, preferably obtained by substantially reducing its thickness. The several reasons for providing the armature piece with a neck that is of reduced cross-section area and is inclined to the anchor and armature portions are explained in detail in U.S. Pat. No. 3,586,809. Briefly, the armature portion has a reduced mass because of the presence of the neck, so as to be readily accelerated by magnetic forces acting upon it; the slender neck provides a relatively flat spring rate that further insures responsiveness of the armature to magnetic forces; and the inclination of the neck to the armature portion enables the neck to absorb a certain amount of vibration from the armature portion, thereby substantially lessening the tendency for the contacts to rebound upon closure of the switch.

The neck portion of the armature piece is so disposed that the armature portion 16 is forwardly spaced from the armature stop post 18 along most of its length and can engage that stop only at the tip thereof. Furthermore, it is important that the armature piece be so installed as to be under a resilient rearwardly preload that tends to maintain its armature portion engaged under bias against the tip of the armature stop. To obtain a controlled preload of the armature against the armature stop, the armature piece comprises a bimetal strip which is initially installed with an excessive but indeterminate preload and is brought to the desired preload by heat treatment, all as fully explained in U.S. Pat. No. 3,586,809. The function of the armature stop is also explained in that patent, and is further explained in Santi U.S. Pat. No. Re. 27,315.

Before proceeding to a more detailed consideration of the armature stop of the present invention, attention should be given to the contactor 19 which is carried by the armature portion 16 of the armature piece 13. In general that contactor is formed as a generally U-shaped piece of molybdenum wire that has the outer end portions 20 of its legs looped inwardly back upon themselves. These doubled-back portions 20 of the contactor legs lengthwise overlie the flat rear face of the armature portion and are secured to it as by weldments. The unattached portions of the contactor legs extend along the rear face of the armature, in rearwardly spaced relation to it along most of their lengths, but they normally engage the tip of the armature under resilient forward bias. The bight portion 22 of the contactor is bent forwardly out of the plane of its legs to project across the tip of the armature and forwardly beyond its front face. The transversely extending portion of the contactor is straight and flattened, as at 24, to provide a contact surface of substantial area that is engageable with the opposing surface of the contact member 12.

When the armature portion 16 of the armature piece moves forwardly under the influence of a magnetic field, the forwardly projecting contact surface 24 of the contactor encounters the contact member 12 somewhat before the armature itself makes contact therewith. Since the wire contactor has a forward preload relative to the armature 16, and the armature has substantially greater mass than the contactor 19, the contact portion of the contactor is maintained in engagement with the contact member 12 by the magnetic force acting upon the armature piece and the momentum of the armature acquired during its rapid acceleration by the actuating field.

The contactor 19 thus cooperates with the relatively stationary contact 12 to provide an initial current path through the switch at switch closure. The flattening of the transverse contact portion 24 of the contactor ensures that contact occurs over a substantial area, to provide a low resistance current path through the switch.

A very brief instant after the contactor 19 engages the contact member 12, the armature itself comes into engagement with that contact member, providing a second current path in parallel with the one through the contactor. Because of these parallel current paths, the closed switch has a resistance so low as to be negligible for practical purposes.

While the switch is held closed by the actuating magnetic field, the armature 16 is strongly urged back towards its open position under the dual biasing forces imposed upon it by the flexed neck portion 14 of the armature piece and the preload bias of the contactor 19 relative to the armature. Hence when the magnetic field force drops to a switch opening value, the armature rapidly accelerates away from the contact member 12 under the combined influence of these biasing forces. By the time its tip reengages the legs of the contactor 19, the armature has acquired a substantial momentum, so that its abrupt engagement with the free end portion of the contactor literally kicks the latter out of engagement with the contact member 12, overcoming any tendency towards contact sticking.

To cooperate with the molybdenum contactor, the contact member 12 has a contact surface of pure tungsten. To facilitate manufacture, the tungsten contact can comprise a small, flat substrate piece 26, flatwise welded to the contact member at its side adjacent the armature and having a coating 27 of pure tungsten on its exposed face. The rod-like element 7 with which the molybdenum contactor 19 is connected comprises the positive terminal of the switch; the rod-like element 6 that carries the tungsten contact surface 27 comprises its negative terminal. With the respective tungsten and molybdenum contacts so connected and operating in the deep vacuum environment of the envelope interior, the switch has a useful life of unprecedented length — on the order of several billion cycles — for reasons that are explained in U.S. Pat. No. 3,586,809. Reference can also be made to that patent for a more complete explanation of the functions of the contactor 19.

To prevent magnetic and cold-welding type sticking between the armature 16 and the contact member 12, there is a tungsten-to-tungsten contact between them, which has the further advantage of affording low contact resistance in the vacuum environment of the envelope interior. For such contact the front face of the armature, at the tip portion thereof, is coated with pure tungsten, as at 28, and engages the tungsten coating 27 on the contact piece 26.

Returning now to a consideration of the post-like armature stop 18 towards which the armature 16 is resiliently biased, it will be apparent that this member tends to define the switch-open position that the armature assumes and thus enables the switch device to have a small contact gap in its open condition, so that the armature can respond rapidly to magnetic actuating fields of small value. Another function of the armature stop, and one that is particularly important from the standpoint of the present invention, is to absorb energy from the armature as the armature reaches its normal or switch-open position. The need for this function is best understood from a consideration of the switch-opening movement of an armature that does not have a stop against which it is preloaded.

The armature acquires a substantial amount of momentum as it swings away from the contact member 12 in response to its own flexing bias and the bias that the contactor 19 imposes upon it. In the absence of the armature stop, such momentum would cause the armature to swing well past its normal switch-open position. Because of the resilience of the neck portion 14, the armature would then swing back through that normal position and partway towards its closed position, and it would thus continue in gradually damped oscillation for some substantial time after switch opening. The amplitude and persistence of such swinging oscillation will be apparent from the fact that its frequency would be on the order of 20 to 40 Hz, owing to the low spring constant afforded by the reduced thickness neck portion 14 of the armature piece of this invention.

During the time that such oscillation continued, reclosure of the switch could not be effected in consistently timed relation to a rise in its actuating magnetic field. If the magnetic field picked up the armature during the part of its oscillation cycle in which it was swinging towards its cooperating contact, closure would occur prematurely; whereas closure would be late if the magnetic field picked it up in the opposite half-cycle of its oscillation.

It will be apparent that predictable closure timing of a magnetically actuated switch operated at recurrent short intervals requires that its armature be brought substantially to a stop at its switch-open position within a time period that is substantially less than the shortest expectable interval between operating cycles. This is the function of the armature stop 18.

In preventing free oscillation of the armature, the armature stop will have to absorb energy from it. In a vacuum environment it is not possible to rely on such energy absorbing media as air, oil or rubber. Hence the armature stop is essentially undamped (actually, damped only by its own internal friction) and therefore it will inevitably tend to return some of that energy to the armature. This is to say that there tends to be a more or less brief period of oscillation of the armature and its stop.

In the switches of Santi U.S. Pat. Nos. Re. 27,315 and 3,586,809, the armature stop permitted the armature to have rebounding vibration, but caused such vibration to occur at a high frequency, so that the amplitude of the vibration was low and the energy of the armature was dissipated quite rapidly. As a result, the armature was brought to rest quickly enough so that consistent timing of switch closure could be obtained at frequencies of up to 200 cycles per second.

In the switch of the present invention a pair of vibratile members 30 and 31 are secured to the armature stop to control its vibration after the armature strikes it at the close of its switch-opening swing. The vibratile members serve to absorb a substantial part of the energy that is transferred to the armature stop by abrupt engagement of the armature against it, and they substantially prevent retransfer of that energy back to the armature by delaying the return of that energy to the armature stop until a substantial amount of it has been dissipated in internal friction of the vibratile members. The armature is thus brought to substantially a full stop almost immediately upon reaching its switch open position.

Since the function of the vibratile members is essentially one of controlling the movements that the armature stop makes in response to the energy transferred to it by the armature, and since such control must be effected with due regard to the natural frequency of vibration of the armature stop itself, it is important that the armature stop have a well-defined natural frequency of its own. The provision of the oblique medial portion 17 of the rod-like element 7 serves this purpose, as well as providing for the attachment of the anchor portion of the armature piece. As with the neck portion 14 of the armature piece, the inclination of the armature piece supporting portion 17 to the armature stop post 18 enables the supporting portion 17 to absorb some of the vibration of the armature stop and confines vibrations to the armature stop post portion of the rod-like element 7. Furthermore, the thickness of the end wall 10 of the envelope is not closely controllable, inasmuch as that end wall is formed by fusion of the envelope glass; hence if the armature stop post extended all the way to that end wall, instead of being vibration-isolated from it by the attachment portion 17, the natural frequency of the armature stop could vary from switch to switch.

Another expedient for assuring that the armature stop has a definite natural frequency is illustrated in U.S. Pat. No. 3,586,809, wherein the armature stop post and the terminal member are formed as separate rod-like elements that are welded together end-to-end but in somewhat laterally offset relation to one another. In that case the lateral offset substantially isolates the armature stop from the terminal portion so far as vibration is concerned.

The natural frequency of the armature stop is so chosen that it tends to match the natural frequency of the armature when the latter is engaged with the tip of the armature stop. When the armature is thus engaged, it tends to vibrate as a beam supported at its opposite ends, and it then vibrates at a frequency much higher than its frequency of freely swinging oscillation. The contactor 19, which is carried by the armature, influences the natural frequency of armature vibration when the armature is engaged with the armature stop, and that influence must be taken into account in selecting the natural frequency of the armature stop post. The reason for tuning the armature stop post to a frequency near that at which the armature vibrates when engaged with it is to enable the armature to transfer energy to the armature stop.

The vibratile members 30 and 31 comprise a pair of resilient wires that extend from the tip portion of the armature stop and are secured to it in vibration transmitting relationship. Preferably the two wires are spot welded to the flat front surface of the armature stop post. For tuning the wires, and to encourage a high amplitude of vibration of their tip portions so that they will have effective leverage upon the armature stop, each can be flattened, as at 32, along a portion of its length through a zone just outboard of the tip of the armature stop.

Certain characteristics of the vibratile members are important. They should be secured to a portion of the armature stop that undergoes vibration in response to the impact of the armature — in this case, to the tip of the armature stop post rather than to its anchored or nodal end. They should extend generally transversely to the directions of vibration of the armature stop, preferably extending lengthwise from it as shown. The two wires should be laterally spaced apart by a sufficient distance to enable them to vibrate independently, without contacting one another, and of course they should not contact the envelope or any part of the rod-like element 6. Each of the vibratile members should have a natural frequency which is lower than the natural frequency of the armature stop, the specific relationship between those frequencies being as explained hereinafter. At this point, suffice it to say that the two vibratile members should have different natural frequencies; and to that end the vibratile member 30 is slightly longer than its companion member 31, to have a lower natural frequency. The combined mass of the vibratile members is substantially less than that of the armature stop so that their presence does not substantially influence the natural frequency of the armature stop; hence, each of the vibratile members will have a substantially smaller diameter than the rod-like element 7. To prevent the actuating field from influencing them, the vibratile members should be nonmagnetic, molybdenum wire being very suitable.

To best understand how the natural frequencies of the vibratile members should be related to one another and to the natural frequency of the armature stop, it is necessary to consider in some detail the events that occur during a brief interval following impact of the armature against the armature stop at the conclusion of a rearward swing of the armature towards its switch-open position.

Figure 6:
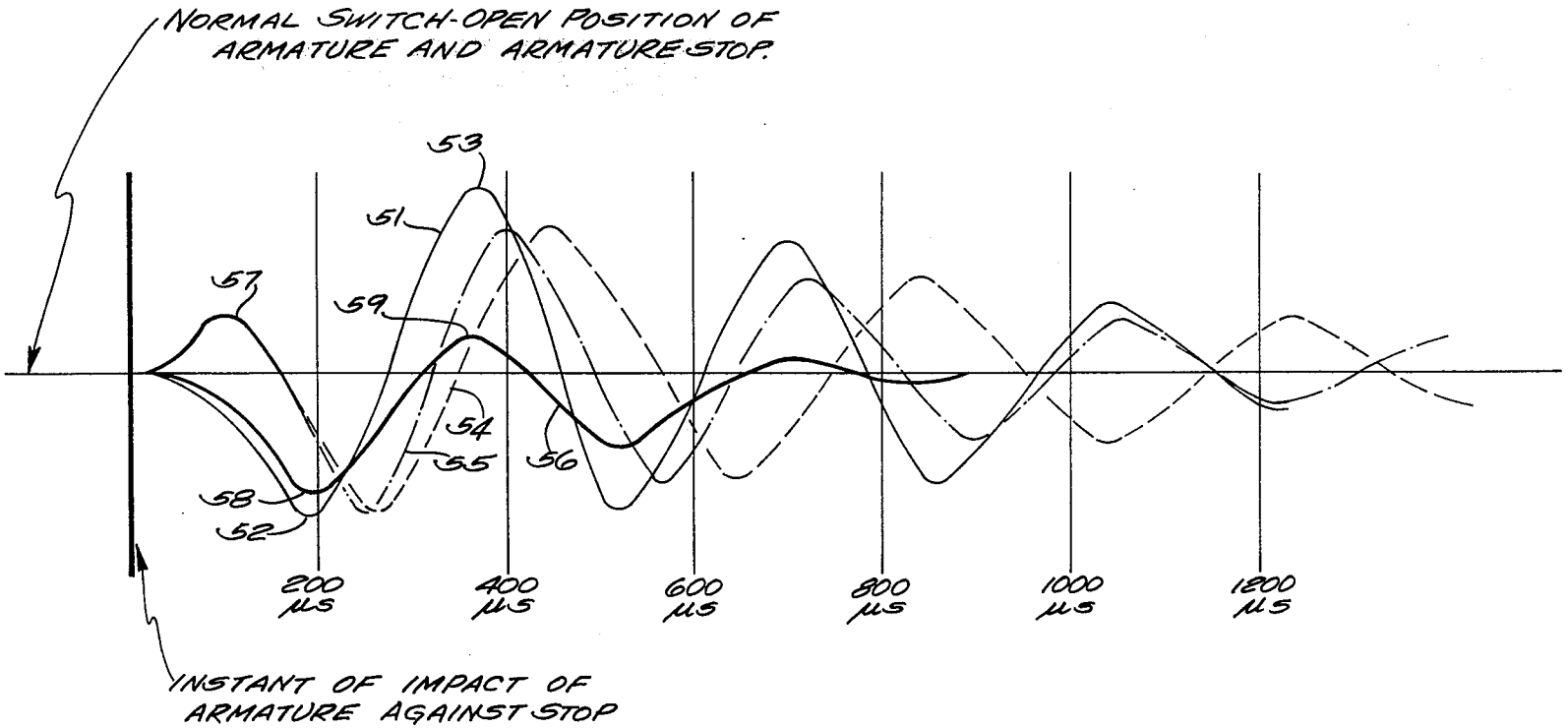
FIG. 6 represents graphically the relationship between the vibratory movements of the vibratile members and the armature stop, plotted against time during an interval beginning with impact of the armature against the armature stop.

In FIG. 6, the line 51 represents the movements of the tip of the armature stop post, plotted against time, as they would be in the absence of the vibratile members, but with the armature engaging the tip of the post.

As mentioned above, the natural frequency of vibration of the armature stop alone is selected to be substantially equal to the frequency at which the armature vibrates when it is engaged with the tip of the armature stop post. However, when the armature and the armature stop are engaged, the two together form an oscillatory system which, for various reasons, has a somewhat lower frequency of oscillation than the natural frequency of vibration of either of them. Among other things, the mass and modulus of elasticity of the system are different from those of its members, and the nodal point about which the system oscillates tends to be different from the respective nodal points of armature and armature stop vibration.

The curve 51 in FIG. 6 depicts oscillatory motions of an armature-armature stop system at a natural frequency on the order of 2,500 Hz. The armature stop post of that system, by itself, has a natural frequency on the order of 4,000 to 5,000 Hz.

It will be observed that during the first several microseconds following impact of the armature against the armature stop, the armature stop is accelerated in the rearward direction (away from the contact member 12) as the armature transfers energy to it. That acceleration is denoted by the increasing downward slope of the curve 51 immediately after the instant of impact, and it should be borne in mind that the curve 51 illustrates conditions that obtain in the absence of the vibratile members.

The first lower cusp 52 of the curve 51 depicts a termination of the rearward swing of the armature stop-armature system and the beginning of a swing forwardly towards the contact member 12. When the armature is at its position denoted by the bottom of the cusp 52, it is farther from the contact member 12 than it would be in its normal switch-open position, and thus, relatively speaking, the armature is under some forward bias. This is to say that there is still some energy stored in the armature. As a result, the forward swing of the armature stop-armature system, which terminates at the first upper cusp 53 of the curve 51, has a somewhat greater amplitude than the rearward swing, and the armature is farther from its normal switch-open position at the time denoted by the cusp 53 than at the time denoted by the cusp 52. If this return swing and the swings that succeed it were permitted to have the high amplitude that they would obtain in the absence of the vibratile members, such wide swings of the armature would represent substantial variations in the air gap dimension of the switch and would materially affect its response to build-up of an actuating magnetic field that occurred while they were in progress.

The shape of the upper cusp 53 of the curve 51 is also of great significance to switch performance, because this cusp represents a deceleration of forward motion of the armature stop followed by an acceleration in the rearward direction. If that cusp is sharply peaked rather than bluntly rounded (that is, if the rate of change of armature stop motion is too high), the armature will separate from the armature stop.

It will be apparent that the upward slope of the curve 51 from the first lower cusp 52 to the first upper cusp 53 is also significant to the operating characteristics of the switch, because in that portion of the curve the armature stop tends to be retransferring energy back to the armature. If that portion of the curve has a steep (nearly vertical) slope, signifying rapid forward movement of the armature stop, the armature is correspondingly accelerated in the forward direction, and a rapid reversal of armature stop swing (peaked cusp 53) then makes separation of the armature from the armature stop virtually inevitable. If such separation occurs, the portion of the curve 51 that is to the right of the cusp 53 will have one or more irregularities, rather than being smooth as shown, such irregularities being due to recollisions of the armature and armature stop and corresponding to overtones in a vibratory system.

With respect to the armature stop, such separation and recollision would not be objectionable in themselves, but they would be indicative of a high amplitude swinging of the armature and would thus signify an objectionable condition. However, when the armature collides with the contact member 12 it forms with that contact member an oscillatory system that behaves very much like the one involving the armature stop; and in that case separation of the armature from its cooperating stop member is of course highly objectionable, even though the oscillation parameters of the armature-contact member system are not particularly significant in themselves. In each case, therefore, the return swing of the member impacted by the armature should have a low amplitude and should terminate with a gradual deceleration and a gradual re-acceleration in the opposite direction.

The lines 54 and 55 in FIG. 6 depict the movements of the tips of the vibratile members 30 and 31, respectively, during the period for which the curve 51 is plotted; and the line 56 depicts the motion of the armature stop-armature system during the same period, as that system is affected by the motions of the vibratile members.

Although each of the vibratile members has a lower natural frequency than the bare armature stop post alone, the frequencies of the vibratile members are so chosen that each of them is substantially resonant with the frequency of the oscillatory system comprising the armature stop and the armature. Of course the two vibratile members have different natural frequencies, and therefore at least one of them will be slightly out of perfect resonance with the armature stop-armature system; but resonance is a relative matter and what is required is that the several involved frequencies be close enough to one another to enable ready transferrence of energy from the armature stop-armature system to the vibratile members, and vice versa.

When the armature impacts the armature stop, energy transferred from the armature to the armature stop is further transferred from the latter to the vibratile members. The tips of the vibratile members initially swing forwardly, substantially in unison, to the point denoted by the cusp 57 on the then-coinciding curves 54 and 55. When energy is transferred from one to another of a coupled pair of resonant oscillatory elements, the oscillations of the two elements are 90° out of phase with one another, and the oscillations of the energy receiving element lag those of the energy imparting element. Hence, at about the halfway point in the initial rearward movement of the armature stop (about 90° into the first cycle of armature stop oscillation), the tips of the vibratile members begin to swing rearwardly with it. During that rearward swing the vibratile members are still moving substantially in unison, owing to the smallness of the frequency difference between them. The vibratile members continue this rearward motion while the armature stop-armature system reverses its direction of motion as denoted by the cusp 58 on the curve 56. Note that the armature stop does not swing quite as far rearwardly as it would in the absence of the vibratile members (the cusp 58 of the curve 56 is above the corresponding cusp 52 of the curve 51), owing to the energy absorbed by the vibratile members at impact of the armature against the armature stop.

Due to the approximately 90° phase difference, the vibratile members are still in their initial rearward swings after the armature stop-armature system has reversed its initial rearward motion and until it has moved through about half of its subsequent forward swing. The vibratile members terminate their first rearward swings at slightly different times, and thereafter the frequency difference between them becomes increasingly apparent.

In swinging rearwardly while the armature stop swings forwardly, the vibratile members are taking energy from the armature stop that would otherwise be employed in imparting forward acceleration to the armature. This is to say that the vibratile members impede the first forward swing of the armature stop, causing that swing to have a substantially slower speed and lower amplitude than it would have in their absence, as denoted by the comparatively low slope of that portion of the curve 56 that is immediately to the right of the cusp 58 and by the location and shape of the cusp 59 of the curve 56, which cusp is near the normal switch-open position of the armature. The cusp 59, which depicts the reversal of the first forward swing of the armature stop, and which can be compared with the cusp 53 of the curve 51, is well rounded, rather than sharply peaked, because it represents a deceleration from a lower velocity of forward swing and a rearward acceleration under a lesser amount of energy. Owing to the low rate of change of motion represented by the cusp 59, there is little tendency for the armature to separate from the armature stop.

The energy that the vibratile members have received from the armature stop during the first forward swing of the latter causes their immediately succeeding forward swing to have a high amplitude. To the extent that such energy transferred to the vibratile members and stored in them, it is not available for maintaining the armature stop-armature system in oscillation.

If the two vibratile members were vibrating at the same frequency, they would retransfer energy back to the armature stop at some time after the armature stop had attained the position denoted by the cusp 59. They do not do so, however. At about the time that the armature stop is making its second rearward swing (denoted by the portion of the curve 56 that is directly to the right of the cusp 59), the frequency difference between the vibratile members has brought their vibrations into substantially out-of-phase relationship to one another. Because they are so connected with one another through the armature stop that energy can be transferred back and forth between them, the tendency for the leading (higher frequency) vibratile member to transfer energy to the lower frequency one now begins to manifest itself in a phase shift between them that hastens the attainment of the 90°-out-of-phase relationship between their vibrations at which such energy transfer can be most readily effected.

Thus, at the time the vibratile members could be expected to begin retransferring energy back to the armature stop, there begins, instead, a transference of energy between the vibratile members. Specifically, the higher frequency vibratile member first transfers some energy to the lower frequency one, during the period in which the vibrations of the high frequency vibratile member lead those of the low frequency member by about 90°. Then, as the frequency difference between the vibratile members continues to cause change in the phase relationship between their vibrations, their vibrations come into a 180°-out-of-phase relationship to one another, at which neither transfers energy to the other and they oppose one another in their efforts to transfer energy back to the armature stop. Since this 180°-out-of-phase relationship represents a temporary state of energy equilibrium, the phase shift between the vibratile members that began as they approached the 90°-out-of-phase relationship tends to continue through the 180°-out-of-phase relationship, hastening the onset of that equilibrium condition and somewhat delaying its termination. After a time, however, the higher frequency vibratile member comes into 90°-out-of-phase lagging relationship to the lower freqeuency vibratile member, and the latter then retransfers energy back to the higher frequency one. With continued vibration, the frequency difference between the vibratile members will eventually bring their vibrations back into phase with one another. However, by the time their vibrations attain this reinforcing relationship, the vibratile members have dissipated so much energy in their own internal friction that their vibrations are of negligible amplitude, and they are unable to effect any significant displacement of the armature step.

As the vibratile members approach their initial 90°-out-of-phase relationship, there appears to be some phase shift as between the two vibratile members and the armature stop-armature system, owing to the tendency for the vibratile members to transfer energy back to that oscillatory system. But because such retransfer does not occur, a low amplitude oscillations of the armature stop-armature system are readily damped by its own internal friction, and its oscillations become imperceptible long before perceptible vibrations of the vibratile members have terminated.

The foregoing explanation of the functioning of the vibratile members in their relation to the armature stop-armature system conforms with theory and seems to be supported by actual observations. More intensive research and more minutely exact observation may show it to be inaccurate or incomplete in some respects. But there can be no doubt that the effect of the vibratile members is to receive and store energy that would otherwise be expended in oscillations of the armature stop-armature system, and to dissipate such energy in their own internal friction. The energy transferred to the vibratile members is of course manifested in their vibrations, and because of the frequency difference between them they are capable of storing that energy until it is substantially dissipated in their internal friction. Since they are incapable of retransfering energy back to the armature stop only during the interval when their vibrations are mutually interfering, the frequency difference between them must be so chosen that that interval will begin early enough to prevent their retransfer of energy to the armature stop while it is still in oscillation and will continue long enough so that the amplitude of their vibrations is practically negligible by the time they come back into reinforcing in-phase relationship to one another.

A frequency difference between the vibratile members that is on the order of 500 to 1,000 Hz has been found satisfactory for the particular switch herein described.

Although the vibratile members have small mass as compared to the system comprising the armature and the armature stop, they can recieve and store a substantial amount of energy from that system owing to their high leverage about the nodal end of the armature stop post.

Note that in the illustrated example, which is typical, the armature stop has attained a substantially quiescent state after about 600 microseconds from the instant of impact of the armature against it, even though the vibratile members continue in vibration fr a substantially longer time, as would the armature-armature stop system in the absence of the vibratile members. Hence, owing to the vibratile members, any rise in the actuating magnetic field that occurs 600 microseconds or more after the instant of impact can effect a predictably timed reclosure of the switch.

Conceivably even this very short interval could be further reduced by selecting a higher natural frequency for the armature and the armature stop and correspondingly raising the frequencies of the vibratile members. However, to enable sufficient energy to be stored in the vibratile members under those conditions, it might be necessary to use three or more of them, all of them, of course, having natural frequencies that differ from one another, but all having frequencies substantially resonant with the oscillation frequency of the armature stop-armature system.

Preferably the two vibratile members should exert equal forces upon the armature stop. The vibratile member 31 of higher frequency is not only shorter than its companion but moves more slowly owing to the lower amplitude of its vibration. Therefore the member 31 should have a somewhat greater mass than the member 30; and since it must normally have a lesser length, the additional mass will ordinarily be obtained by giving it a larger diameter. The basis for calculating the relative diameters of the vibratile members is the relationship $$E = MV^2,$$

where E is the energy stored in the member and which produces its vibratory motion, M is the moving mass of the member, and V is the mean velocity of its vibratory motion. For the two vibratile members to exert equal forces upon the armature stop, equal amounts of energy should be stored in them.

Obviously the armature stop and the vibratile members should be of such nature that they naturally vibrate at substantially pure frequencies. Overtones are undesirable because they tend to interfere with the desired phase relationship between the vibrations of the components. In practice this means that the vibratory movements of the armature stop and vibratile members should not bring them into contact with other parts of the mechanism nor be otherwise influenced by extraneous forces. It is for this reason that the vibratile members are made of non-magnetic material.

Molybedenum wire is preferred for the vibratile members not only because it is non-magnetic but also because of its hardness. The abrupt and relatively heavy impacts of the armature against the armature stop entail the danger of cold welding that would cause the armature to stick to the armature stop. To avoid this, the armature is formed with a rearwardly projecting embosture of bumper 33 that is so located as to engage at least one of the vibratile members at the zone of its weldment to the armature stop. The hard molybdenum wire is resistant to cold welding, and hence sticking of the armature in its open position is more surely prevented than if the armature engaged the armature stop proper.

Upon switch closure, as explained above, the light wire contactor 19 first engages the contact member 12, and a small fraction of a second thereafter the armature itself impacts against that member. The contactor 19 has relatively little mass, and therefore it does not, by itself, transfer enough energy to the contact member 12 to be caused to rebound, especially since the swinging armature exerts substantial force upon the contactor that maintains it engaged with the contact member 12. The armature itself, however, has both a relatively large mass and a high velocity when it is brought to a stop against the member 12, and therefore it transfers a substantial amount of energy to that member. In the absence of means for controlling the resultant vibratory motion of the contact member 12, its pattern of vibration would be as depicted by the curve 51 in FIG. 6, and the amount of energy tranferred to it by the armature impact could be great enough to cause rebound of both the armature itself and the contactor 19.

Of course such contact rebound, or socalled make bounce, has long been recognized as undesirable in any switch. To prevent it, the contact member 12 is provided with a pair of vibratile members 36 and 37 that cooperate with it in essentially the same manner that the vibratile members 30 and 31 cooperate with the armature stop 18.

In the switch of the present invention, wherein the relatively stationary contact member 12 comprises the axially innermost portion of the rod-like element 6, that contact member is isolated from the remainder of the rod-like element, so far as vibration is concerned, by a flattened, reduced thickness neck portion 34 on the rod-like element that is spaced a short distance inwardly from its adjacent end wall 10 of the envelope. The provision of the neck portion 34 thus assures that the contact member 12 will have a definite natural frequency of vibration. In addition, since the neck portion is lengthwise oblique to the contact member, it tends to absorb vibration thereof.

The natural frequency of the contact member 12, like that of the armature stop post, is selected to be substantially resonant with the vibration frequency of the armature when the armature is engaged against that contact member. However, the frequency at which the armature tends to vibrate when it is in contact with the contact member 12 is different from its frequency of vibration when it is in contact with the armature stop. One reason for this difference is that the armature engages its extreme tip portion against the contact member 12, whereas a portion of it that is spaced some distance inwardly from its tip engages against the armature stop. The contactor 19 also has different effects upon frequency of armature vibration in the respective switch-open and switch-closed positions of the armature, owing to the preloaded connection between that contactor and the armature. In a typical switch wherein the natural frequency of the bare armature stop (disengaged from the armature and without the vibratile members) is on the order of 4,500 Hz, the proper natural frequency for the contact member 12 is on the order of 7,500 Hz. The frequency of oscillation of the system comprising the armature in engagement with the contact member 12 is again lower than the natural frequency of either component of that system, and is on the order of 5,500 Hz.

As in the case of the armature stop, the vibratile members 36 and 37 are secured in vibration transmitting relation to the tip portion of the contact member 12, and they comprise lengths of wire tuned to different frequencies that are lower than the natural fundamental frequency of the contact member itself and substantially in resonance with the natural frequency of oscillation of the system comprising that contact member and the armature engaging it. As shown, the vibratile members are spot welded to the contact member at the side thereof remote from the armature, so that they do not interfere with contact between the relatively movable parts and the contact member. The front and back surfaces of the contact member portion of the rod-like element 6 can be flattened to faciliate the securement to it of the vibratile members and the tungsten contact substrate 26. The vibratile members extend lengthwise from the tip of the contact member, in laterally spaced relation to one another and in spaced relation to the envelope and to the other rod-like element 7 and the parts carried thereby.

The particular configuration of the vibratile members 36 and 37 that is here illustrated, with a pair of small angular bends along their lengths, has no relation to their vibratory functions but, instead, enables them to serve as locating members by which proper orientation of the contacts is effected during assembly of the switch in accordance with the teachings of U.S. Pat. No. 3,550,268 to J. D. Santi.

From the above description of the functioning of the vibratile members 30 and 31, it will be apparent that the vibratile members 36 and 37 reduce both the velocity and amplitude of the return swing of the contact member 12 after the armature strikes it, and they materially decrease its rate of change of motion during the critical short interval in which its separation from the armature would tend to occur. In other words, the vibratile members 36 and 37 receive from the contact member 12 energy that would otherwise be available to effect contact separation, and they store that energy long enough for it to be substantially dissipated before it can be transferred back to the contact member.

Again, the capability of the vibratile members 36 and 37 for storing energy and delaying its transfer back to the contact member 12 is due to the difference in natural frequency between them. For both sets of vibratile members a frequency difference on the order of 500 to 1,000 Hz between the vibratile members of a pair affords satisfactory results.

In theory the amplitude of oscillation of the system comprising the contact member 12 would seem to depend upon the rate of rise of the magentic actuating field, inasmuch as the amount of energy imparted to the contact member depends upon the velocity of the armature at the time of its switch-closing impact. In practice, however, it is not necessary to take account of variations in magnetic field parameters if the switch follows the teachings of U.S. Pat. No. 3,586,809 and has its armature piece made as a bimetallic strip. Such an armature piece tends to be magnetically saturated in the presence of a magnetic field not greatly exceeding that required for reliable switch closure, and therefore always has about the same velocity of closing motion irrespective of the characteristics of the field that actuates it.

Preferably the frequencies of the system comprising the vibratile members 36 and 37 are nonresonant with those of the system comprising vibratile members 30 and 31. The reason for this is that in the switch-closed condition the armature bridges both systems and could therefore transfer energy from one to the other if the two systems had resonant components. It would obviously be undesirable for the armature stop to be in substantial vibratory motion when the armature swung to its switch-closed position. In a switch incorporating the herein disclosed structure, a frequency difference between the two systems tends to be inherent, for reasons explained above, and it is only necessary to be sure that the two system frequencies are not low order harmonics of one another.

It is also a desirable inherent feature of the herein disclosed switch that the system comprising the contact member 12 has a higher natural frequency of oscillation than the system comprising the armature stop. The higher frequency system tends to have a lower amplitude of oscillation, and the amplitude of oscillation of the first full swing of the contact member 12 is critical because it determines whether or not contact separation will occur at switch closure. On the other hand, if the switch is not required to have nicely predictable closure timing at extremely high cycle speeds, there can be a relatively long interval between impact of the armature against the armature stop and the attainment of substantial quiescence by the armature stop; and at low cycle speeds even some rebounding of the armature from its stop may be tolerable.

Switches embodying the principles of this invention, subjected to the most exacting oscilloscope tests, have been found not to have any contact rebound whatsoever upon closure. Furthermore, this highly desirable characteristic has been achieved consistently from switch to switch throughout the range of cycle speeds of such switches. Such tests have also shown very consistent timing of closure in relation to build-up of magnetic actuating field at all cycling rates up to at least 400 cycles per second and under both steady-rate cycling and varying-rate cycling.

From the foregoing description taken with the accompanying drawings it will be apparent that this invention provides a magnetically actuated switching device having the desirable response characteristics of solid state devices for cycling rates up to about 400 Hz but having substantially greater gain and power handling capability than known solid state devices.

Those skilled in the art will appreciate that the invention can be embodied in forms other than as herein disclosed for purposes of illustration.

The invention is defined by the following claims.

I claim:

1. An electrical switching device wherein a movable contacting element is biased in one direction of its motion and is moved in the opposite direction by an actuating force, and wherein movement of said contacting element in one of said directions brings it into abrupt engagement with a cooperating element, said switching device being characterized by:

A. said cooperating element being
   1. so supported as to be capable of vibratory motion at one natural frequency and
   2. so located and oriented that energy transferred thereto by abrupt engagement of said contacting element thereagainst tends to produce oscillatory motion of said elements, engaged with one another and acting as a system, in said directions and at another frequency; and B. a plurality of elongated vibratile members, each secured at one end in vibration transmitting relationship to said cooperating element and projecting away from the same, and each having its length transverse to said directions so that said vibratile members can vibrate in said directions relative to the cooperating element,
   1. the natural fundamental frequency of such vibration of every vibratile member being substantially resonant with said other frequency so that energy which tends to cause high amplitude of oscillation of the engaged elements can be transferred to and stored by the vibratile members to be manifested in their vibrations, but
   2. said vibratile members having different natural fundamental frequencies of such vibration so that their vibrations mutually interfere to delay retransfer of energy back to the cooperating element until such energy has been substantially dissipated in internal friction of the vibratile members.

2. The electrical switching device of claim 1 wherein there are two vibratile members and the vibratile member which has the higher frequency of vibration in said directions has greater mass than the other vibratile member, so that the amount of energy which can be stored in each vibratile member and manifested in its vibration is substantially equal to that which can be stored in the other.

3. The electrical switching device of claim 1 wherein said cooperating element is elongated, extends substantially transversely to said directions and is supported at only one of its ends;

wherein there are two of said vibratile members, each comprising a wire of substantially lesser thickness than said cooperating element; and wherein the vibratile member having the lower vibration frequency is longer than the other one.

4. In an electrical switching device wherein a movable armature member is biased in one direction of its motion and is moved in the opposite direction by an actuating force, and wherein movement of said armature member in one of said directions brings it into abrupt energy transferring engagement with a cooperating member, means for substantially preventing rebounding separation of said members immediately after their engagement with one another, the last mentioned comprising:

A. resilient means supporting said cooperating member for vibratory motion in said directions at one natural fundamental frequency so that energy transferred to the cooperating member by engagement of the armature member thereagainst tends to be manifested in oscillatory motion, in said directions and at another frequency, of said members in engagement with one another and acting as a system; and B. oscillatory motion control means secured in vibration transmitting relationship to said cooperating member, comprising a plurality of elongated vibratile members which extend away from said cooperating member in spaced relation to one another, with their lengths substantially transverse to said directions, 1. each of said vibratile members having a natural fundamental frequency of vibration in said directions which is substantially resonant with said other frequency so that the vibratile members are capable of readily receiving energy from the cooperating member that would otherwise contribute to the magnitude and velocity of oscillation of said system, but 2. the natural fundamental frequencies of said vibratile members being different from one another so that energy transferred to them from said cooperating member and manifested in their vibrations is substantially dissipated by them while mutual interference between their vibrations prevents its retransfer back to said cooperating member.

5. An electrical switching device of the type comprising an elongated armature having a tip portion on which there is a contactor and which swings rapidly in opposite directions to carry said contactor into and away from abrupt engagement with a cooperating contact, said switching device being characterized by:

A. resilient means supporting said cooperating contact for vibratory motion in said directions and at one natural fundamental frequency; and B. a plurality of elongated vibratile members, each secured at one end to said cooperating contact and each projecting therefrom with its length oriented transversely to said directions so that energy transferred to said vibratile members from said cooperating contact upon abrupt engagement of the armature thereagainst causes them to vibrate in said directions, said vibratile members 1. being so spaced from one another as to be capable of independent vibration, 2. each having a natural fundamental frequency which is substantially resonant with the frequency at which the armature and said cooperating contact, engaged with one another and acting as a system, tend to oscillate in said directions, but 3. having natural fundamental frequencies which are sufficiently different from one another that their vibrations are mutually interfering, to prevent retransfer of energy from them back to said cooperating contact, for a long enough period to enable energy transferred to them from said cooperating contact at impact of the armature thereagainst to the substantially dissipated in their internal friction.

6. In an electrical switching device comprising an elongated magnetically permeable armature which is swingable to enable a tip portion thereof to be moved in one direction, to a switch-closed position, by a build-up of a rapidly cycling magnetic actuating field, and which is resiliently biased in the opposite direction, towards a defined switch-open position, means for enabling the armature, after each return movement to its switch-open position, to be actuated to its switch-closed position in precisely timed relation to an immediately subsequent rapid build-up of the magnetic field, the last-named means comprising:

A. an elongated resilient stop member having a tip portion at one end thereof that can have vibratory motion transversely to the length of the stop member at one natural fundamental frequency when the stop member is supported from its other end;

B. means so supporting the stop member from its said other end that 1. it extends lengthwise substantially parallel to the armature, 2. it is oriented for said vibratory motion of its tip portion in said directions, and 3. its tip portion is located to be impactingly engaged by a portion of the armature when the armature when the armature moves to its switch closed position and to be engaged under bias by the armature when the armature is in that position, so that kinetic energy transferred to the stop member by impacting engagement of the armature against it tends to cause oscillatory motion in said directions and at another frequency of the engaged armature and stop member acting as a system;

C. a pair of elongated vibratile members secured in vibration transmitting relation to the tip portion of the stop member and projecting lengthwise therefrom substantially in alignment therewith and in laterally spaced relation to one another, 1. said vibratile members being capable of vibration in said directions, each at a natural fundamental frequency substantially resonant with said other frequency, so that kinetic energy can be transferred from the stop member to the vibratile members to be unavailable for effecting oscillatory motion of said system, but
2. said vibratile members having natural fundamental frequencies which are different from one another so that energy transferred to the vibratile members is stored in them and substantially dissipated by them, without retransfer back to said system, during a period in which their vibrations are in interfering relation to one another.

7. The electrical switching device of claim 6 further characterized by:

1. said vibratile members being of a wire having at least the hardness of molybdenum; and
2. said vibratile members being secured to the tip portion of the stop member at the side thereof that faces the armature and at a location thereon to be impacted by the armature so that the vibratile members, by reason of their hardness, prevent cold welding of the armature to the stop member.

8. The electrical switching device of claim 7 wherein said vibratile members are secured to the stop member by a localized weldment, further characterized by:

3. the armature having an embosture that provides a bumper which projects in said opposite direction and which is engageable with at least one of said vibratile members at the zone of said weldment.

9. The electrical switching device of claim 6 wherein said armature and said stop member are enclosed in an envelope having one wall near said other end of the stop member, further characterized by:

1. said stop member comprising an elongated inner portion of a rod-like element which extends through said wall of the envelope and has
   a. an outer portion that provides a terminal for the switching device and
   b. another inner portion between said wall and the stop member, which other inner portion extends lengthwise oblique to the stop member and has the stop member projecting therefrom; and
2. the armature comprising one end portion of an elongated strip-like armature piece,
   a. the opposite end portion of said armature piece comprising an anchor portion that is secured to said other portion of the rod-like element, and
   b. a portion of the armature piece between the armature and said anchor portion being a resiliently flexible neck of lesser cross-sectional area than the anchor and armature portions.

10. An electrical switching device of the type comprising a pair of elongated magnetically permeable switch members, one of which comprises an armature having a tip portion that is biased in a rearward direction, away from the other switch member, but swings in a forward direction, toward the other switch member, under the force of a magnetic field threading the switch members, said device further comprising a pair of contacts, one carried by each of said switch members, that are engaged upon forward swinging of the tip portion of the armature, said device being characterized by:

A. a resilient elongated contactor carried by the armature, said contactor
   1. being secured to the armature at a location thereon which is spaced from its tip,
   2. being resiliently preloaded to normally engage the tip portion of the armature under forward bias but to be yieldable rearwardly relative to the armature, out of such engagement, and
   3. having a portion which normally projects forward beyond the front side of the armature and which comprises the contact carried by the armature, said contactor thus enabling the armature to continue in forward swinging motion after the contacts are engaged so that forward forces on the armature can act through the contactor to resist rebounding separation of the contacts;

B. the other elongated switch member having its contact spaced from one of its ends and being so supported at its said end
   1. as to be oriented with its length substantially transverse to said directions, and
   2. to be capable of carrying its contact in vibratory motion in said directions at one natural fundamental frequency, so that upon impacting engagement of the armature with said other switch member the armature and said other switch member tend to oscillate in unison in said directions at another frequency; and C. a pair of elongated vibratile members secured to said other switch member in vibration transmitting relation thereto and projecting lengthwise therefrom, said vibratile members
   1. having natural fundamental frequencies of vibration in said directions which are substantially resonant with said other frequency, so that energy transferred to said other switch member from the armature upon its impacting engagement against the same can in turn be transferred to the vibratile members to cause them to vibrate in said directions, but
   2. each of said vibratile members having a natural fundamental frequency of such vibration which differs from that of the other, so that mutually interfering vibrations of the vibratile members prevent energy transferred to the vibratile members from being retransferred to said other elongated switch member until such energy has been substantially dissipated in internal friction by the vibratile members.

11. The switch device of claim 10 wherein each of said contacts is of a metal at least as hard as molybdenum, to resist cold welding of the contacts as a result of their impacting engagement.

12. The switching device of claim 10, further characterized by:

a third contact on the tip portion of the armature, engageable with said contact carried by said other switch member upon further forward swinging of the armature beyond the point of engagement of the first mentioned contacts.

13. An electrical switch device wherein a movable switch element is subjected to forces that move it alternately in opposite directions towards and from a cooperating element, and wherein the force that moves said movable element in the direction towards said cooperating element causes it to engage said cooperating element with an energy transferring impact and tends to maintain it engaged under bias against said cooperating element, said switch device being characterized by:

A. said cooperating element being mounted for vibratory motion in said directions at one natural fundamental frequency, so that in consequence of impacting engagement of the movable element against said cooperating element the engaged elements tend to oscillate in unison at another frequency; and B. a plurality of vibratile members, 1. each of said vibratile members having a securement to said cooperating element that provides
   a. for transfer of energy from the cooperating element to the vibratile member and
   b. for such energy transfer to result in vibration of the vibratile member in said directions relative to said cooperating element;
2. each of said vibratile members having a natural fundamental frequency of such vibration which is substantially resonant with said other frequency, so that sufficient energy can be readily transferred from said cooperating element to the vibratile members to prevent the oscillation of said engaged elements from having an undesired amplitude; but
3. said vibratile members having different frequencies of their vibration so that by reason of their mutually interfering vibrations they are substantially incapable of retransferring energy back to said cooperating element during a period in which most of such energy is dissipated.

* * * * *

UNITED STATES PATENT OFFICE
CERTIFICATE OF CORRECTION

Patent No. 4,011,533 Dated March 8, 1977

Inventor(s) JOHN D. SANTI

It is certified that error appears in the above-identified patent and that said Letters Patent are hereby corrected as shown below:

Col. 1: Line 63, "straight" should be "stringent"
Col. 11: Line 23, "is" should follow "energy"
Col. 12: Line 10, "step" should read "stop"
Line 17, "a" should read "the"
Line 62, "fr" should read "for"
Col. 13: Line 50, "of" should read "or"
Col. 14: Line 41, "the" should follow "upon"
Col. 15: Line 37, "magentic" should read "magnetic"
Col. 16, line 19, after "switch" second occurrence, should be -and-
Col. 17: Line 32, "means" should precede "comprising"
Col. 18: Line 29, "the" should be "be"
Line 57, "when the armature" should be deleted Signed and Sealed this second Day of August 1977

[SEAL]

Attest:

RUTH C. MASON
*Attesting Officer*

C. MARSHALL DANN
*Commissioner of Patents and Trademarks*